US006856091B2

(12) United States Patent
Kelly et al.

(10) Patent No.: US 6,856,091 B2
(45) Date of Patent: Feb. 15, 2005

(54) SEAL FOR CERAMIC METAL HALIDE DISCHARGE LAMP CHAMBER

(75) Inventors: Timothy Lee Kelly, Boston, MA (US); Jagannathan Ravi, Bedford, MA (US); Huiling Zhu, Lexington, MA (US)

(73) Assignees: Matsushita Electric Industrial Co., Ltd., Osaka (JP); Matsushita Electric Works, Ltd., Osaka (JP)

( * ) Notice: Subject to any disclaimer, the term of this patent is extended or adjusted under 35 U.S.C. 154(b) by 56 days.

(21) Appl. No.: 10/178,831

(22) Filed: Jun. 24, 2002

(65) Prior Publication Data

US 2003/0234612 A1 Dec. 25, 2003

(51) Int. Cl.[7] ..... H01J 17/18; H01J 61/36; H01J 5/50

(52) U.S. Cl. ..... 313/623; 313/326; 313/331; 313/332

(58) Field of Search ..... 313/623, 331, 313/332

(56) References Cited

U.S. PATENT DOCUMENTS

| | | | | |
|---|---|---|---|---|
| 5,075,587 A | | 12/1991 | Pabst et al. | 313/25 |
| 5,352,952 A | | 10/1994 | Juengst | 313/623 |
| 5,404,077 A | | 4/1995 | Eichelbrönner et al. | 313/623 |
| 5,404,078 A | | 4/1995 | Bunk et al. | 313/625 |
| 5,424,608 A | | 6/1995 | Juengst et al. | 313/623 |
| 5,424,609 A | | 6/1995 | Geven et al. | 313/623 |
| 5,430,353 A | * | 7/1995 | Feldman et al. | 313/623 |
| 5,446,341 A | | 8/1995 | Hofmann et al. | 313/623 |
| 5,532,552 A | | 7/1996 | Heider et al. | 313/623 |
| 5,552,670 A | * | 9/1996 | Heider et al. | 313/625 |
| 5,592,049 A | | 1/1997 | Heider et al. | 313/625 |
| 5,637,960 A | | 6/1997 | Juengst et al. | 313/625 |
| 5,742,123 A | | 4/1998 | Nagayama | 313/623 |
| 6,597,114 B1 | * | 7/2003 | Tagawa et al. | 313/623 |
| 6,600,266 B1 | * | 7/2003 | Nakagawa | 313/623 |

FOREIGN PATENT DOCUMENTS

JP 2000-90881 3/2000

OTHER PUBLICATIONS

U.S. Appl. No. 09/776,253, Kelly et al., filed Feb. 2, 2001.
J. Chu, H. Ishibashi, K. Hayashi, H. Takebe, and K. Morinaga. Slip Casting of Continuous Funtionally Gradient Material. *Journal of the Ceramic Society of Japan*, vol. 101 [No. 7], pp. 841–844, 1993.
J.J. de Groot and J.A.J.M. van Vliet. *The High–Pressure Sodium Lamp*, Phillips Technical Library, Antwerp, Belgium (1986); Chapter 8: Discharge–Tube Material and Ceramic–to–Metal Seal (pp. 227–253).

* cited by examiner

*Primary Examiner*—Nimeshkumar D. Patel
*Assistant Examiner*—Matt Hodges
(74) *Attorney, Agent, or Firm*—Kinney & Lange, P.A.

(57) ABSTRACT

A discharge chamber for an arc discharge metal halide lamp having light permeable walls bounding a discharge region in which ionizable materials are provided with at least one electrode accommodation opening therein extending along a selected path between that discharge region and a region outside those walls. An electrode arrangement extends through the electrode accommodation opening having therein a thin electrical conductor positioned at least in part therein with a major surface that has surface curvature in at least some of those portions thereof positioned in said electrode accommodation opening to be in one of many alternative configurations. A sealing frit of mixed metal oxides is positioned about at least a portion of the thin electrical conductor within the electrode accommodation opening both at the major surface thereof and on an opposite side thereof.

19 Claims, 10 Drawing Sheets

SEAL FOR CERAMIC METAL HALIDE DISCHARGE LAMP CHAMBER

BACKGROUND OF THE INVENTION

This invention relates to high intensity arc discharge lamps and more particularly to high intensity arc discharge metal halide lamps having high efficacy.

Due to the ever-increasing need for energy conserving lighting systems that are used for interior and exterior lighting, lamps with increasing lamp efficacy are being developed for general lighting applications. A kind of high efficacy lamp is the arc discharge metal halide lamp that is being more and more widely used for interior and exterior lighting. Such lamps are well known and include a light-transmissive arc discharge chamber sealed about an enclosed pair of spaced apart electrodes and typically further contain suitable active materials such as an inert starting gas and one or more ionizable metals or metal halides in specified molar ratios, or both. They can be relatively low power lamps operated in standard alternating current light sockets at the usual 120 Volts rms potential with a ballast circuit, either magnetic or electronic, to provide a starting voltage and current limiting during subsequent operation. Their superior performance with respect to other kinds of high pressure arc discharge lamps in measures such as luminous efficiency, color rendering and color stability is responsible for their increasing use.

The better performance of these lamps is due to the higher operating temperatures possible for the ceramic arc discharge tubes ceramic material than can be achieved with lamps using quartz material arc tubes, as well as the more precise dimensional control that is possible with ceramic tubes formed with sintered powders previously compacted in molds providing for preformed openings for electrodes to be inserted than for quartz tubes formed from an oxide that is heated to have a viscosity allowing it to be pressed against the electrodes provided therewith. The seal obtained between a polycrystalline alumina (PCA) ceramic tube and the two spaced apart access electrodes each extending from the enclosed space in the tube interior formed by its bounding walls to the tube exterior is critical to the successful operation over substantial periods of time for this lamp in view of the extreme conditions occurring in this interior space during lamp operation.

High pressure sodium lamps utilize niobium as the electrode material for the discharge chamber access electrodes extending between the chamber interior and the region outside the chamber since its thermal coefficient of expansion (TCE) is well matched to that of polycrystalline alumina. Such electrodes are joined to the polycrystalline alumina by a ceramic sealing frit formed of mixed metal oxides having a thermal expansion coefficient similar to both that of polycrystalline alumina and niobium. This sealing frit is also resistant to sodium based corrosion at the high temperatures encountered in the discharge chamber during lamp operation.

However, this arrangement is not suitable for metal halide lamps having ceramic arc discharge chambers since the salts of the halides therein are corrosive to both niobium and the sealing frit used, this being so even with such discharge chambers being operated at the lower cold spot temperatures usual for metal halide lamps because of the greater chemical activity of halides. Consequently, a variety of alternative arrangements have been tried as possible bases for overcoming the sealing problem involving access electrodes in ceramic arc discharge tubes used in metal halide lamps.

Refractory metals, such as molybdenum, tungsten, platinum, rhodium, rhenium, etc., are resistant to halide corrosion during lamp operation and may be used as materials for access electrodes. They, however, typically have lower corresponding thermal coefficients of expansion than that of polycrystalline alumina as shown in the Table below. As a result of thermal cycling during each lamp operation and over the operating life of the lamp, such large differences between the thermal coefficients of expansion of the access electrodes and the ceramic material in the arc discharge tube body leads to separations between the metallic access electrodes and the ceramic arc discharge tube bodies in which they positioned. These separations can cause seal fracture leaks of the vapors in the arc discharge tube enclosed space, and even fractures of the tube itself near these electrodes thereby leading to loss of arc discharge tube hermeticity.

TABLE

Thermal Coefficients of Expansion of Commonly Used or Possibly Used Metal Halide Lamp Materials

| Materials | Approximate Thermal Coefficients of Expansion Values ($\mu$m/m/K) |
|---|---|
| Alumina | 8.0 |
| Aluminum nitride | 5.4 |
| Niobium | 8.0 |
| Molybdenum | 6.0 |
| Tungsten | 5.2 |

In general, sealing methods for sealing access electrodes in the arc discharge tube body can be divided into four categories—use of a sealing frit, sintering the tube body about the electrode, use of graded thermal expansion coefficient seals that substantially match the thermal expansion coefficient of the electrode on one side thereof and that of the body on the other side, and use of altogether new arc tube materials. Some of the methods within these categories overlap in practice (for example, the use of graded plug material to effect a seal by sintering).

A typical ceramic arc discharge tube, 20, in present use for a ceramic metal halide lamp formed about an enclosed, or contained, region as a preformed shell structure is shown in FIG. 1, this enclosed region containing various ionizable materials, including metal halides and mercury which emit light during lamp operation and a starting gas such as argon or xenon. In this structure for tube 20, a pair of polycrystalline alumina, relatively small inner and outer diameter truncated cylindrical shell portions, or capillary tubes, 21*a* and 21*b*, are each concentrically joined to a corresponding one of a pair of polycrystalline alumina end closing disks, 22*a* and 22*b*, about a centered hole therethrough so that an open passageway extends through each capillary tube and through the hole in the disk to which it is joined. These end closing disks are each joined to a corresponding end of a polycrystalline alumina tube, 25, formed as a relatively large diameter truncated cylindrical shell, to be about the enclosed region to provide the primary arc discharge chamber. These various portions of arc discharge tube 20 are formed by compacting alumina powder into the desired shape followed by sintering the resulting compact to thereby provide the preformed portion, and the various preformed portions are joined together by sintering to result in a preformed single body of the desired dimensions.

Thus, there results two pathways from regions outside arc discharge tube 20 into the primary chamber region enclosed within ceramic arc discharge tube 20, each along a corresponding one the passageways having a selected diameter and extending through the preformed capillary tubes and end closing disks. The passageways thus formed are each to accommodate a corresponding access electrode arrangement. This configuration results in lower temperatures in the sealing regions in the capillary tubes during lamp operation since the ends of the electrode arrangements extend through the capillary, or electrode tubes, into the enclosed chamber a significant distance thereby spacing them, and the discharge arc established between them, further from the seal regions in the electrode tubes at the ends of discharge tube 20.

The electrode arrangement in each of these passageways is provided in three parts including in the left electrode arrangement a small diameter outer part niobium rod, 26*a*, surrounded by a ceramic sealing frit, 27*a*, in electrode tube 21*a* except where joined to the middle part molybdenum or cermet rod, 29*a*, by a butt weld, this niobium rod extending from that electrode tube to the outside of arc discharge tube 20. In the right electrode arrangement, there is included a small diameter outer part niobium rod, 26*b*, surrounded by a ceramic sealing frit, 27*b*, in electrode tube 21*b* except where joined to the middle part molybdenum or cermet rod, 29*b*, by a butt weld, the niobium rod similarly extending from that electrode tube to the outside of the arc discharge tube 20. At the other end of the left electrode arrangement, a small diameter inner part tungsten rod, 31*a*, is positioned adjacent one end of rod 29*a* and extends from electrode tube 21*a* into the enclosed region of arc discharge tube 20. An electrode coil, 32*a*, is mounted on the end of rod 31*a* in the enclosed region of arc discharge tube 20. Similarly, at the other end of the right electrode arrangement, a small diameter inner part tungsten rod, 31*b*, is positioned adjacent one end of rod 29*b* and extends from electrode tube 21*b* into the enclosed region of arc discharge tube 20. An electrode coil, 32*b*, is mounted on the end of rod 31*a* in the enclosed region of arc discharge tube 20.

Since tungsten rods 31*a* and 31*b*, with electrode coils 32*a* and 32*b* mounted thereon, respectively, must be positioned in the corresponding one of electrode tubes 21*a* and 21*b*, and extend into the enclosed region in arc discharge tube 20, after the fabrication of arc discharge tube 20 has been completed, the diameter of the passageways extending through the preformed electrode tubes and end closing disks must have inner diameters exceeding the outer diameters of the corresponding one of electrode coils 32*a* and 32*b*. As a result, there are substantial annular spaces between the outer surfaces of tungsten rods 31*a* and 31*b* and the inner surfaces of electrode tubes 21*a* and 21*b* which are taken up in part by the provision of molybdenum coils, 34*a* and 34*b*, around and against corresponding portions of tungsten rods 31*a* and 31*b*, and which also extend to be around and connected to corresponding portions of rods 29*a* and 29*b*, to complete the interconnections thereof and reduce the condensation of the metal halide salts in these regions. These interconnections could also be provided by butt welds. Thus, a right electrode arrangement, 35*a*, and a left electrode arrangement, 35*b*, result.

Electrode arrangements 35*a* and 35*b* have "compromise" properties components in the seal regions, these being outer part niobium rods 26*a* and 26*b* which provide very good thermal expansion matching to the polycrystalline alumina but which are also subject to chemical attack during operation by the metal halides within arc discharge tube 20. The exposure length of each of these outer parts within arc discharge tube 20 must be limited thus requiring the presence of the bridging middle part of the electrode arrangement, usually a molybdenum or cermet rod, between it and the tungsten electrode. Care is also taken to ensure that the melted sealing frits flow completely around and beyond the niobium rods thereby forming a protective surface over the niobium against the chemical reactions due to the halides. The frit flow length inside the capillary tube needs to be controlled very precisely. If the frit length is short, the niobium rod is exposed to chemical attack by the halides. If this length is excessive, the large thermal mismatch between the frit and the solid middle part molybdenum, tungsten or cermet rod beyond the niobium rod leads to cracks in the sealing frit or polycrystalline alumina in that location. These electrode arrangements with a complex construction requiring butt welds or crimpings therealong, also demand strict monitoring of the sealing process as indicated above. If the niobium could have some other material substituted therefor at the seal location, the electrode fabrication and the subsequent sealing process used therewith can be simplified and made more resistant to halide based chemical corrosion during operation as well.

Ceramic sealing frits 27*a* and 27*b* of mixed metal oxides are more halide resistant than the ones used in high pressure sodium lamps in effecting the seals between the polycrystalline alumina of the corresponding electrode tube and the corresponding niobium rod. However, while resistant, this sealing frit is not impervious to chemical attacks. Thus, elimination of niobium at the seal location would make possible a minimum and non-critical exposure length for the sealing frit within the electrode tubes In these circumstances, of course, other ceramic arc discharge tube constructions for ceramic metal halide lamps that make use of different sealing methods have been used. These include methods such as direct sintering of polycrystalline alumina to the electrode arrangement, the use of cermets and graded thermal coefficient of expansion seals, or even the use of new arc tube materials that enable straight sealing of the tube body to a single material electrode such as molybdenum or tungsten. There have been occasional introductions of lamps that used a cermet to replace niobium. But these alternative methods have not yet been able to demonstrate an overall advantage with respect to improved lamp performance, lower cost, or compatibility with existing lamp factory processes.

In a further alternative, a substituted material portion electrode arrangement for ceramic metal halide lamps has been used. The most significant change involves the substitution of a flat molybdenum foil for a portion of the niobium or cermet rod in the sealing regions of the electrode tubes in electrode arrangements 35*a* and 35*b* of FIG. 1 as can be seen in the corresponding electrode arrangement, 35*a*' or 35*b*', shown in FIG. 2. In the full electrode arrangement view of FIG. 2A, a niobium rod, either 26*a* or 26*b*, is again provided in electrode arrangements 35*a*' or 35*b*' (could alternatively be molybdenum) but this rod is joined to the middle part molybdenum or cermet rod, either 29*a* or 29*b*, by a flat molybdenum foil, 36, also shown in cross section in FIG. 2B, welded to both the niobium and middle part rods. As before, the other end of the middle part rod is connected to the tungsten electrode rod, either 31*a* or 31*b*, by an annular space filling coil, either 34*a* or 34*b*, that is also wrapped therearound.

Molybdenum foil 36 forms a seal with the sealing frit, either 27*a* or 27*b*, and the polycrystalline alumina of the electrode tube, either 21*a* or 21*b* when positioned as one of the electrode arrangements shown in FIG. 1, and, to reduce thermal stresses, is chosen to be of a thickness less than 0.05 mm. Further reduction of stresses resulting from a right angles terminating edges in the sealing frit is obtained by beveling these edges to a point as shown for a beveled edge molybdenum foil, 36', in the cross section view of FIG. 2C. A further measure taken to improve the mechanical and thermal properties of the molybdenum foil is doping with metal oxide particles such as yttrium oxide. Adding some surface roughness to the foil, as obtained for example by sand blasting or chemical etching, can also improve adhesion thereof to the frit during sealing.

However, electrode arrangements 35*a*' or 35*b*' of FIG. 2 require molybdenum foil 36 or 36' to be wider than the diameter of the passageways extending through the preformed electrode tubes, either 21*a* or 21*b*, and the end closing disks, either 22*a* or 22*b*, of the structure of a typical size commonly used for arc discharge tube 20 if sufficient electrical current carrying capability is to be provided by that foil for the allowed thickness thereof. The diameter of these passageways cannot be increased because that implies the outer diameter of the electrode tubes would also have to increase to maintain sufficient tube wall thickness thereby increasing the thermal masses of these electrode tubes which would either alter the operating regime for arc discharge tube 20 or require a redesign thereof. As a result, use of electrode arrangements 35*a*' or 35*b*' of FIG. 2 necessitates proving slits across from one another in the walls of each of electrode tubes 21*a* and 21*b* to accommodate therein molybdenum foils 36 or 36' if the structure of the commonly used for arc discharge tube 20 is to be retained. Thus, there is a desire for an electrode arrangement to be in arc discharge tube 20 that does not require a cost increasing modification of the commonly used structure for this discharge tube.

BRIEF SUMMARY OF THE INVENTION

The present invention provides an arc discharge metal halide lamp for use in selected lighting fixtures having a discharge chamber with light permeable walls bounding a discharge region of a selected volume in which ionizable materials are provided with at least one electrode accommodation opening therein extending along a selected path between that discharge region and a region outside those walls. Extending through the electrode accommodation opening is an electrode arrangement having therein a thin electrical conductor positioned at least in part in said electrode accommodation opening with this thin electrical conductor having a major surface with extents in perpendicular surface directions that are both larger than that extent of the thin electrical conductor in a thickness direction perpendicular to the perpendicular surface directions, the major surface of the thin electrical exhibiting surface curvature in at least some of those portions thereof positioned in said electrode accommodation opening so that it may have many alternative configurations. A sealing frit of mixed metal oxides is positioned about at least a portion of the thin electrical conductor within the electrode accommodation opening both at the major surface thereof and on an opposite side thereof.

DETAILED DESCRIPTION

Figure 1:
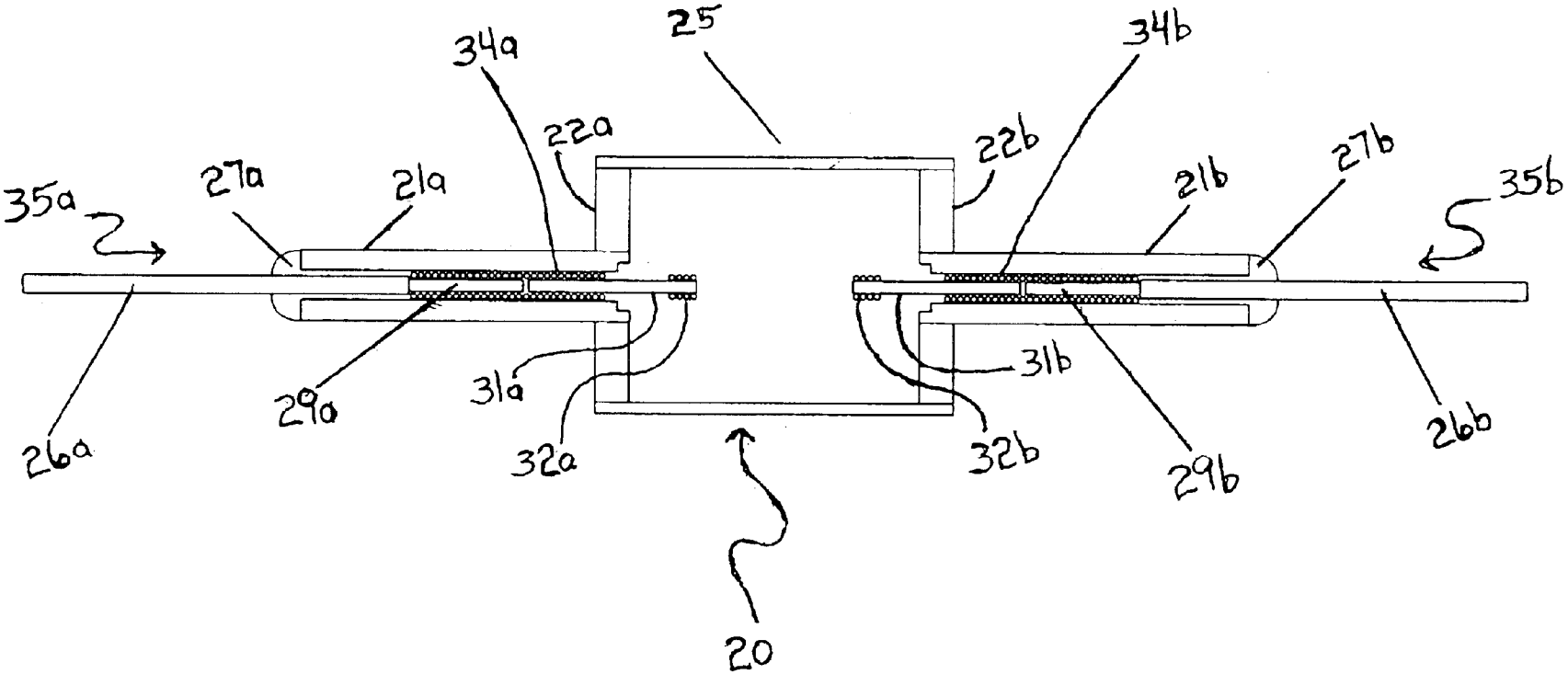
Related Art Fig. 1
FIG. 1 shows a side view in cross section of an arc discharge tube.

The requirement that the sealing frit used with the electrode arrangement shown in FIG. 1 extend far enough to be certain that the niobium rod is covered but not so far along the middle part molybdenum or cermet rod that the thermal expansion mismatch with temperature leads to fracturing the sealing frit or the electrode tube, or both, is difficult to meet. Since the niobium rod is so well matched in thermal coefficient of expansion to that of the polycrystalline alumina of the electrode tube, the niobium rod is desired to be retained which must then be adequately covered by the sealing frit to protect it from corrosion due to the halides during operation.

Thus, relief from the now required precision for the sealing frit extent in the electrode tube along the electrode arrangement must be found from avoiding the fracture of the sealing frit, or even the electrode tube, in the vicinity of the electrode arrangement middle part molybdenum or cermet rod. Such fracturing can result from the thermal changes encountered during operation because of the mismatch in the thermal coefficients of expansion between that middle part rod and both the sealing frit and the electrode tube. Much of the advantage of the cylindrical shape of the middle part rod in welding that rod to the tungsten and niobium rods on either side thereof can be retained while concurrently reducing the thermal stresses arising over temperature changes by using, instead of a rod or portion of a rod, a thin electrical conductor such as a metal foil either formed as at least a part of a thin cylindrical shell or as a thin strip flexible enough to be used to provide a helical wrap shell, or to use some other thin-walled alternative structural arrangement. Such an arrangement can provide sufficient foil material to carry the necessary electrical current load without having to alter the commonly used electrode tubes provided in commonly used discharge tubes, and further provides an open interior space to receive the tungsten and niobium rods therein, or part of a middle rod therein, along with the sealing frit therein and thereabout.

Figure 2C:
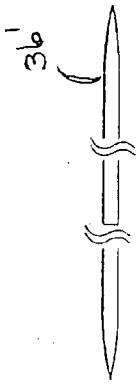
Fig. 2C Related Art
FIGS. 2A, 2B and 2C show side views of an electrode arrangement, and portions thereof, for use in a arc discharge tube.
Figure 2B:
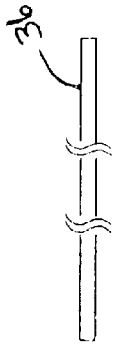
Figure 2A:
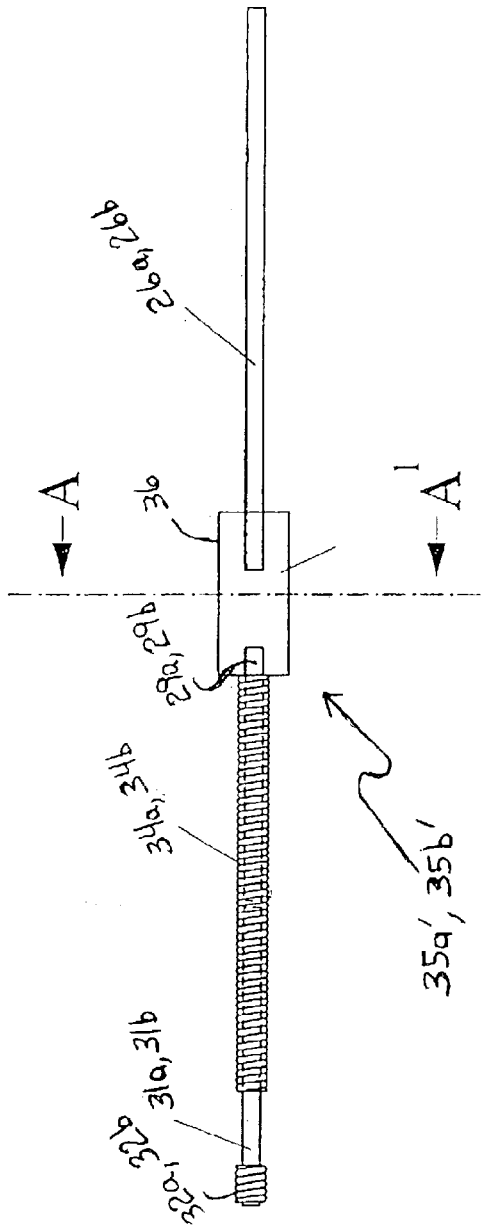

The use of a thin, and typically flexible, electrical conductor such as a metal foil or sheet or strip for such a formed foil structure will result in significantly lower thermal stress thereabout over temperature changes as it allows the foil to more easily yield slightly in position with changes in the electrode arrangement over temperature, including allowing elastic and thermoplastic deformations to thereby reduce stresses in the adjacent scaling frit from those that would otherwise arise. These results can be enhanced in many situations by supplementary treatments of the formed foil like those used with the flat, or nearly flat, foil in the electrode arrangement shown in FIG. 2 including beveling foil edges, doping the foil with metal oxide particles, and adding some surface roughness to the foil.

Figure 3:
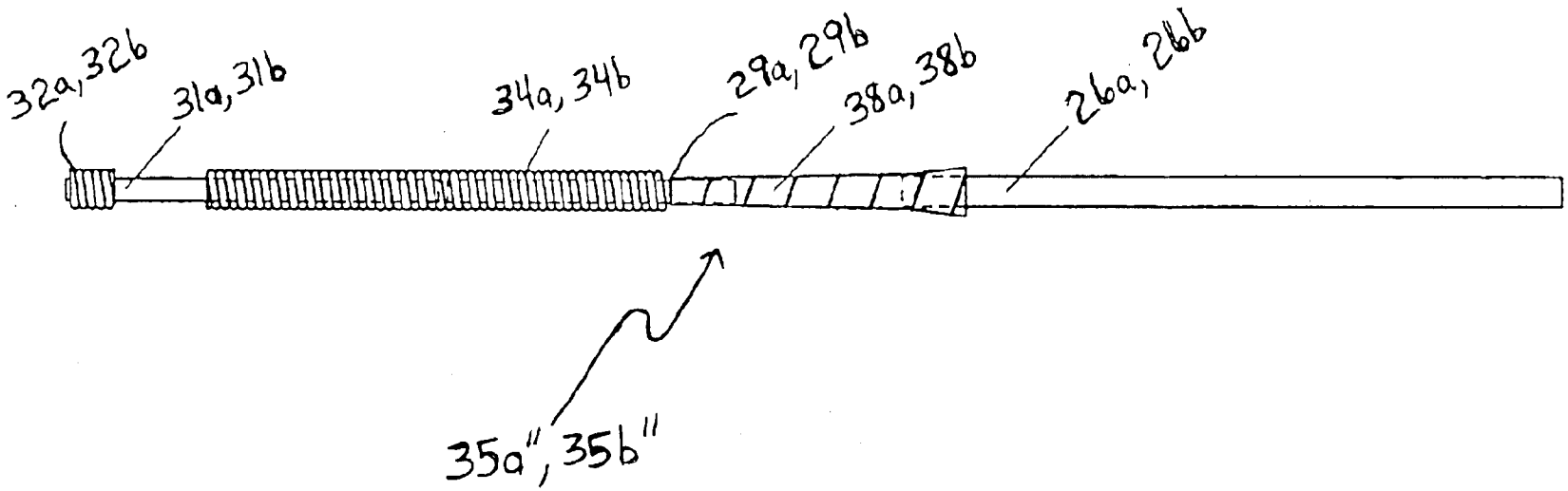
FIG. 3 shows a side view of an electrode arrangement of the present invention for use in a arc discharge tube.

An implementation of such an electrode arrangement is shown in electrode arrangements 35*a*" or 35*b*" in a side view thereof in FIG. 3 which are suitable for standard commercial 150 W ceramic metal halide lamps. There, electrode arrangement 35*a*" or 35*b*" are again seen to have a niobium rod (could alternatively be molybdenum), either 26*a* or 26*b*, again provided in this electrode arrangement with this rod is joined to the middle part molybdenum or cermet rod, either 29*a* or 29*b*, by a molybdenum formed foil, 38*a* or 38*b*, through having a portion of each inserted into a corresponding end of formed foil 38*a* or 38*b* in the open bore thereof where each is welded to that foil. As before, the other end of the middle part rod is positioned adjacent to the tungsten electrode rod, either 31*a* or 31*b*, and an annular space filling coil, either 34*a* or 34*b*, connects them together while also being wrapped therearound.

Figure 4:
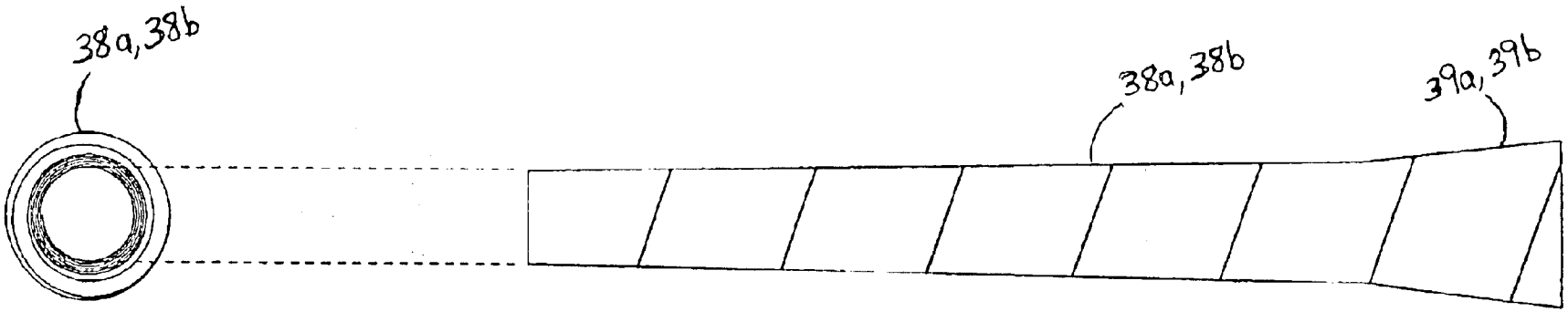
FIG. 4 shows a side view of a portion of the electrode arrangement of FIG. 3.

Formed foil 38*a* or 38*b*, as shown in FIG. 4, is formed by a tape-like, or extended sheet-like, metal wrapping foil with this foil having a tape or sheet thickness less than 0.05 mm (typically, a 0.025 to 0.028 mm thickness) and a tape or sheet width of 3 mm or less (typically, a 2 to 3 mm width). Formed foil 38*a* or 38*b* is formed by having this tape-like or long sheet-like metal foil wound in a manner so as to have the long centerline of the tape or sheet follow, over much of its long extent, a three dimensional helix spatial curve resulting in an interior open bore in the formed foil over much of its extent having a diameter of slightly less than 1 mm and a length of about 7 mm. A mandrel can be used as the form about which to wrap the tape-like or long sheet-like metal foil, if desired, and then can be removed after the formed foil has been completed. The remaining portion of formed foil 38*a* or 38*b* over its remaining extent, rather than having the tape or long sheet centerline following a helix, is shown to spiral outward to form an outwardly flared end, 39*a* or 39*b*, to improve frit flow during the arc tube sealing process, although such a flared end is not necessary.

In a variation of the foregoing electrode arrangement structure, either or both of molybdenum rods 29*a* and 29*b* can be omitted and replaced by extending the corresponding one of tungsten rods 31*a* and 31*b* so that the extension end thereof is in the bore of, and directly welded to, the end of corresponding one of molybdenum formed foils 38*a* and 38*b*. The length of the extended ones of tungsten rods 31*a* and 31*b* would, of course, increase, but molybdenum coils 34*a* and 34*b* can still be wound over a portion of such tungsten rod so as to decrease the annular space between them and the polycrystalline alumina wall in the corresponding one of electrode tubes 21*a* and 21*b*. Molybdenum formed foils 38*a* and 38*b*, at the other ends thereof opposite the ends closest to tungsten rods 31*a* and 31*b*, can be extended in length so as to provide extended formed foils with these opposite ends extending past the corresponding end of electrode tubes 21*a* and 21*b* to thereby dispense with the corresponding one of niobium rods 26*a* and 26*b* in the respective electrode arrangement.

Mixed metals oxides sealing frits 27*a* and 27*b* of FIG. 1 can again be used for the sealing of electrode arrangements 35*a*" and 35*b*" in electrode tubes 21*a* and 21*b*, respectively, by melting these mixtures at typically 1500° C. to 1600° C. and introducing the molten mixtures into electrode tubes 21*a* and 21*b* about electrode arrangements 35*a*" and 35*b*" therein to flow about both the interiors and the exteriors of at least portions of molybdenum formed foils 38*a* and 38*b*. Even though there is a substantial mismatch in the coefficients of thermal expansion between formed foils 38*a* and 38*b* and those frits and electrode tubes, the thin walled molybdenum foil tube with its smaller mass and narrower cross sectional area generates relatively small thermal stresses in the foils, and so in the surrounding frits and electrode tubes, especially if provided with beveled edges, as these components change dimensions differently over temperature changes. This relatively low stress results is achieved because of, as indicated above, such foils being more easily displaced and deformed, both elastically and plastically. Further, these sealing frits, during the sealing procedure, melts and flows between the turns of formed foils in electrode tubes to also be in the bore of such sealed in place formed foils. Thus, such molybdenum formed foils are "sandwiched" by the sealing frit thereabout in being sealed into an electrode tube and, hence, a very good seal results. Also, the material of the sealing frits fills and seals the interior of the formed foils at the outer ends thereof including in the flared portions at those ends to protect well any niobium rod provided therein.

Figure 5:
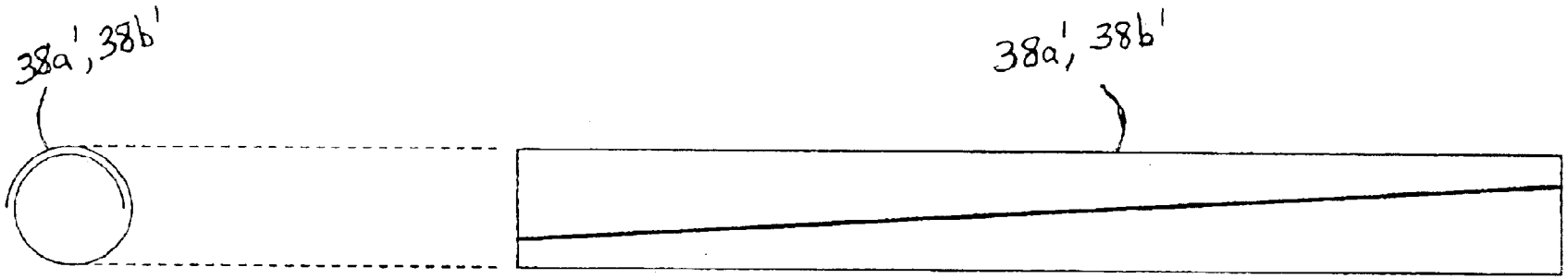
FIG. 5 shows an alternative embodiment for a portion of the electrode arrangement of FIG. 3, FIGS. 6A, 6B, 6C and 6D show end views of further alternative embodiments for a portion of the electrode arrangement of FIG. 3, and FIGS. 7A, 7B, 7C and 7D show broken apart side views in cross section of further alternative embodiments for a portion of the electrode arrangement of FIG. 3, and alternative embodiments for another portion of the electrode arrangement of FIG. 3.

There are a number of different configurations into which a molybdenum foil can be formed to fit inside the passageways extending through the preformed electrode tubes, either 21*a* or 21*b*, and the end closing disks, either 22*a* or 22*b*, of the structure of a typical size commonly used for arc discharge tube 20 (as shown in FIG. 1) in providing formed foil 38*a* or 38*b* to provide electrode arrangements therefor. These various alternative configurations can be provided even though the width, or the length and width, of the molybdenum foil as a flat sheet exceed the diameter or other cross-opening length of those passageways by introducing suitable curvature in the foil surfaces. Thus, in another embodiment, a molybdenum foil initially flat sheet of thickness less than 0.05 mm, width of less than 5 mm and length about 10 mm was rolled up so the centerline of the sheet follows, over much of its extent, a two dimensional circle curve with the resulting formed foils, 38*a*' and 38*b*', approximating a cylindrical shell as shown in FIG. 5. This formed foil, with an open interior bore in its shell-like structure, has a diameter of slightly less than 1 mm and a length of about 10 mm. The assembly for the electrode arrangement is completed as in the previous case. Here again, the sealing frit flows and adheres to both the inner and outer surfaces of the molybdenum formed foil and also plugs the top end thereof. The beveled edges of formed foils 38*a*' and 38*b*' run the length of the seal for maximum hermetic integrity, as they do for formed foils 38*a* and 38*b*.

Other suitable geometrical configurations for a formed foil that allow it to fit inside the passageways extending through the preformed electrode tubes and end disks can offer corresponding different sets of manufacturing advantages either in assembly, or in fabrication, or in both. Thus, FIG. 6A shows an end view of formed foils, 38*a*" and 38*b*",that are a multiply wrapped version of formed foils 38*a*' and 38*b*' of FIG. 5. Such a geometrical configuration can be used in place of, or in place of part of, molybdenum coils 34*a* and 34*b* to fill some of the annular space about the corresponding electrode arrangement positioned in the corresponding electrode tube to thereby reduce the amount of sealing frit 27*a* or 27*b* needed to fill that space.

Figure 6B:
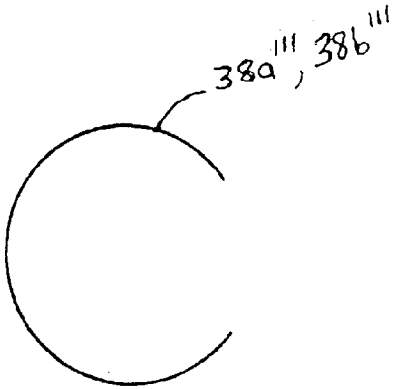
Figure 6A:
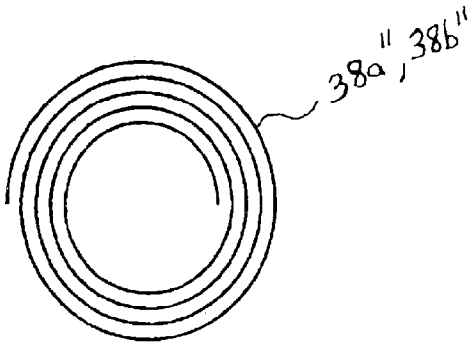

On the other hand, for less easily wrapped foils, perhaps because of being thicker, the end view of formed foils, 38*a*'" and 38*b*'", shown in FIG. 6B are of a partially, or incompletely, wrapped version of formed foils 38*a*' and 38*b*' of FIG. 5 that leave an open side along the length of the formed foils, and which also allows sealing frit to more easily flow into the interior thereof. In a variation of the formed foils shown in FIG. 6B, the foil curvature seen in the end view need not necessarily follow a circular path but instead the open sided formed foil could be formed by merely folding the molybdenum foil sheet into formed foils, $38a^{iv}$ and $38b^{iv}$, with the sort of open channel configuration shown in FIG. 6C. Such a formed foil would be relatively simple to fabricate.

Figure 6D:
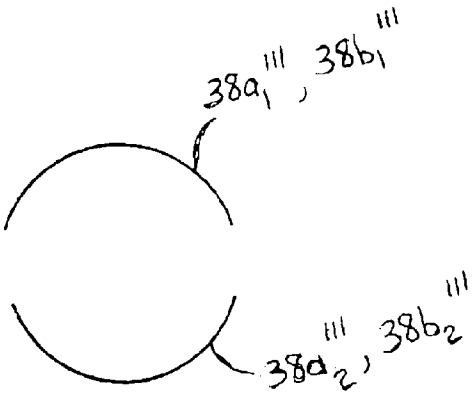
Figure 6C:
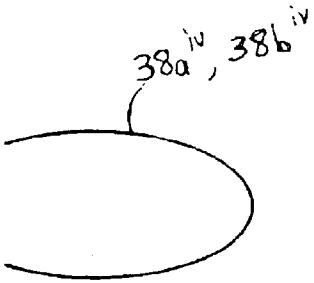

In a situation of even less easily wrapped foils than that shown in FIG. 6B, the partial wrap can be reduced to less than a semicircle, and pairs of such formed foils, 38$a_1$'" and 38$b_1$'" and also 38$a_2$'" and 38$b_2$'", can be provided in the corresponding electrode arrangement in the corresponding electrode tube as shown in FIG. 6D. The choice of a particular geometrical configuration thus depends on the nature of materials available and on the fabrication processes available.

Such geometric configurations for formed foils can have the bore of a surrounding formed foil, or the interior of a formed foil provided by curving the adjacent foil surface sufficiently if not completely thereabout, include therein a space filling rod. Such a rod is to have thermal expansion characteristic similar to that of sealing frits 27*a* and 27*b*, and the capability to withstand lamp sealing and operating temperatures while being chemically resistant to the vaporized halides present in arc discharge tube 20 during operation. An example of such a material for a formed foil interior rod is alumina, which is also suitable for use as a mandrel for the forming of a formed foil thereabout to then be left in place in the resulting formed foil in being positioned in a corresponding electrode arrangement in a corresponding electrode tube. In any event, such a rod is sealed to the inner wall of the molybdenum formed foil after being positioned in the corresponding electrode arrangement in the corresponding electrode tube by the sealing frit as part of the sealing of that electrode arrangement in that electrode tube. Especially in large bore arc tubes, such a configuration helps to control the cold spot temperature since the vaporizable halides condensate is prevented from residing in frit unfilled regions of the molybdenum formed foil.

The outer parts of electrode arrangements 35*a*" and 35*b*", or outer parts 26*a* and 26*b*, can also be provided in various forms with certain ones of these variations of the formed foils. Thus, niobium rods 26*a* and 26*b* above can instead be tube or formed foil structures, and they may be alternatively be of other high melting point metals such as tantalum or molybdenum if the outer parts are provided in the corresponding one of electrode arrangements 35*a*" and 35*b*" prior to their being sealed into the corresponding one of electrode tubes 21*a* or 21*b* by sealing frits 27*a* and 27*b*, respectively, at the high temperatures involved in such sealing. If outer parts 26*a* and 26*b* are provided in the corresponding one of electrode arrangements 35*a*" and 35*b*" after the other electrode portions have been sealed into the corresponding one of electrode tubes 21*a* or 21*b*, lower melting temperature metals such as stainless steel or nickel can be used instead for them. The material chosen for these electrode outer parts 26*a* and 26*b* can again usefully contain dopant materials, for example, metal oxide particles such as yttrium oxide, to improve such properties as having the resulting doped materials of the outer parts better match the surrounding sealing frits to improve adherence therebetween, and be stronger so as not bend as easily under mechanical or thermal loading. One suitable outer part structure uses a niobium rod doped with zirconium.

Figure 7A:
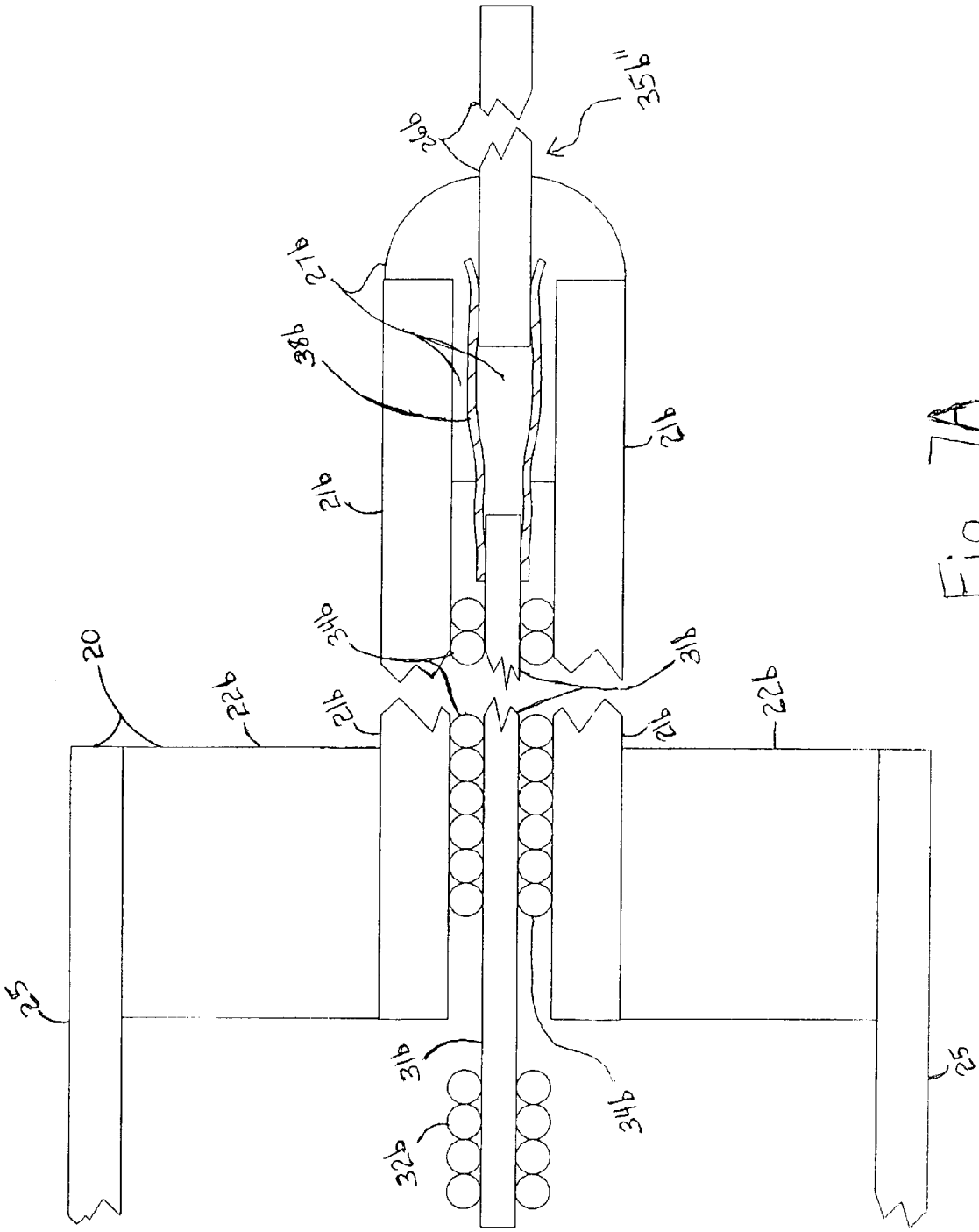
Figure 7B:
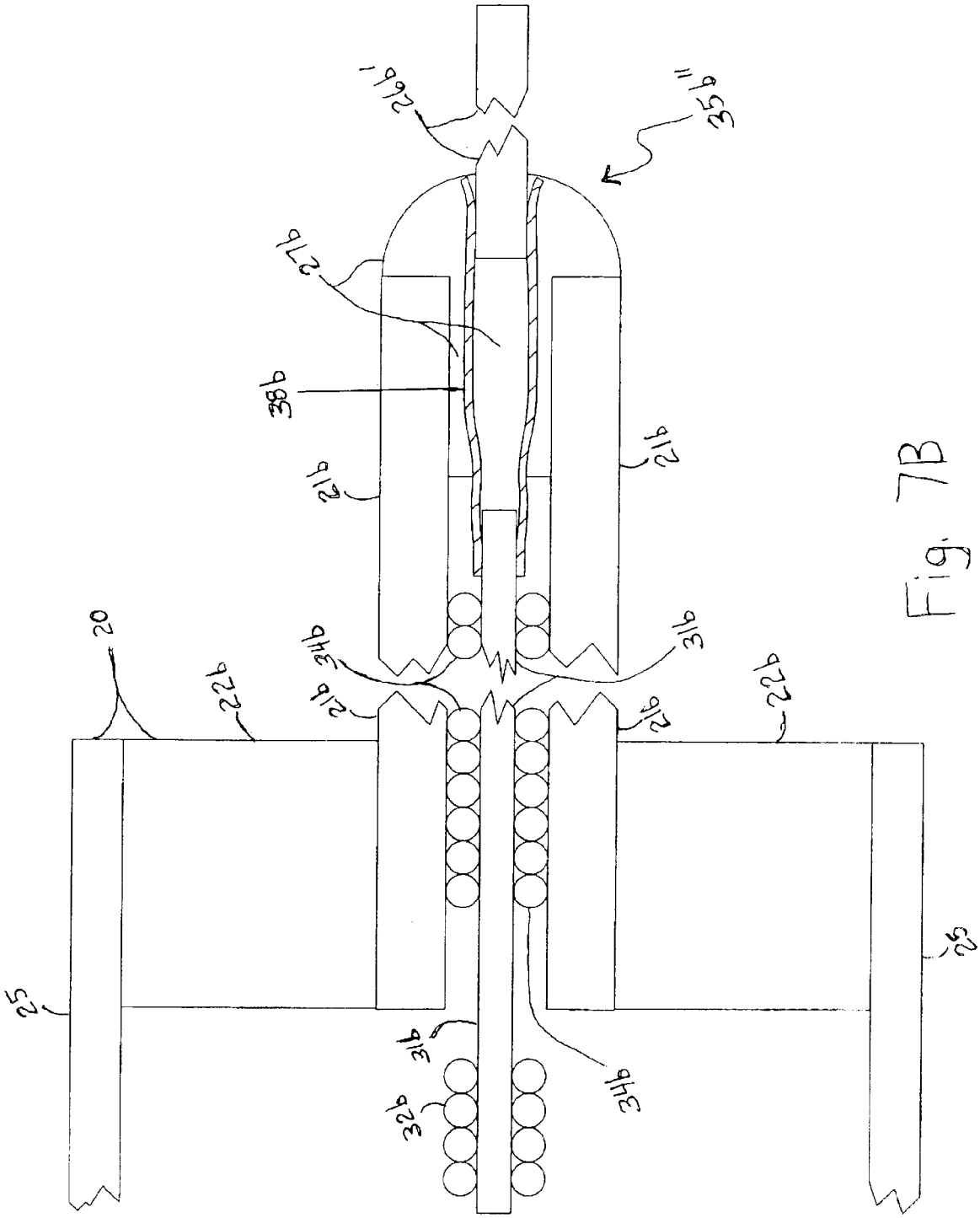

Some alternatives for the electrode arrangements outer parts are shown in the broken away cross section side views of FIGS. 7A through 7D which, in these instances, just show electrode tube 21*b* with nearby portions of arc discharge tube 20 including end closing disk 22*b* connected with a portion of tube 25, and the electrode arrangement 35*b*" provided therein, as the other electrode arrangement in electrode tube 21*a* can be a duplicate. The electrode arrangement 35*b*" of FIG. 7A shows formed foil 38*b* having the wrap portion thereof at one end welded to tungsten rod 31*b* and the end wrap portion at the other end welded to niobium rod 26*b* with that end wrap portion being contained entirely or nearly entirely within electrode tube 21*b*. This assembly is finished prior to sealing with the mixed oxides frit thereafter being melted to flow about formed foil 38*b*, on both the inner and outer sides thereof, and about niobium rod 26*b*, the resulting solidified sealing frit 27*b* being present both within and outside of formed foil 38*b* so that sealing frit 27*b* fills the gaps between formed foil 38*b* and the walls of electrode tube 21*b* and leaves an approximately hemispherical solid frit cap (perhaps more like a conic surface of revolution depending on the viscosity of the molten frit and other related factors) on the end of electrode tube 21*b* about rod 26*b*. In FIG. 7B, the end wrap portion of lengthened formed foil 38*b* is welded to a set back niobium rod, 26*b*', outside of electrode tube 21*b*, and afterward the mixed oxides frit are melted to flow about formed foil 38*b*, on both the inner and outer sides thereof, and about this niobium rod, which is shown positioned with its weld to formed foil 38*b* in the approximately hemispherical solid frit cap on the end of electrode tube 21*b*.

Figure 7C:
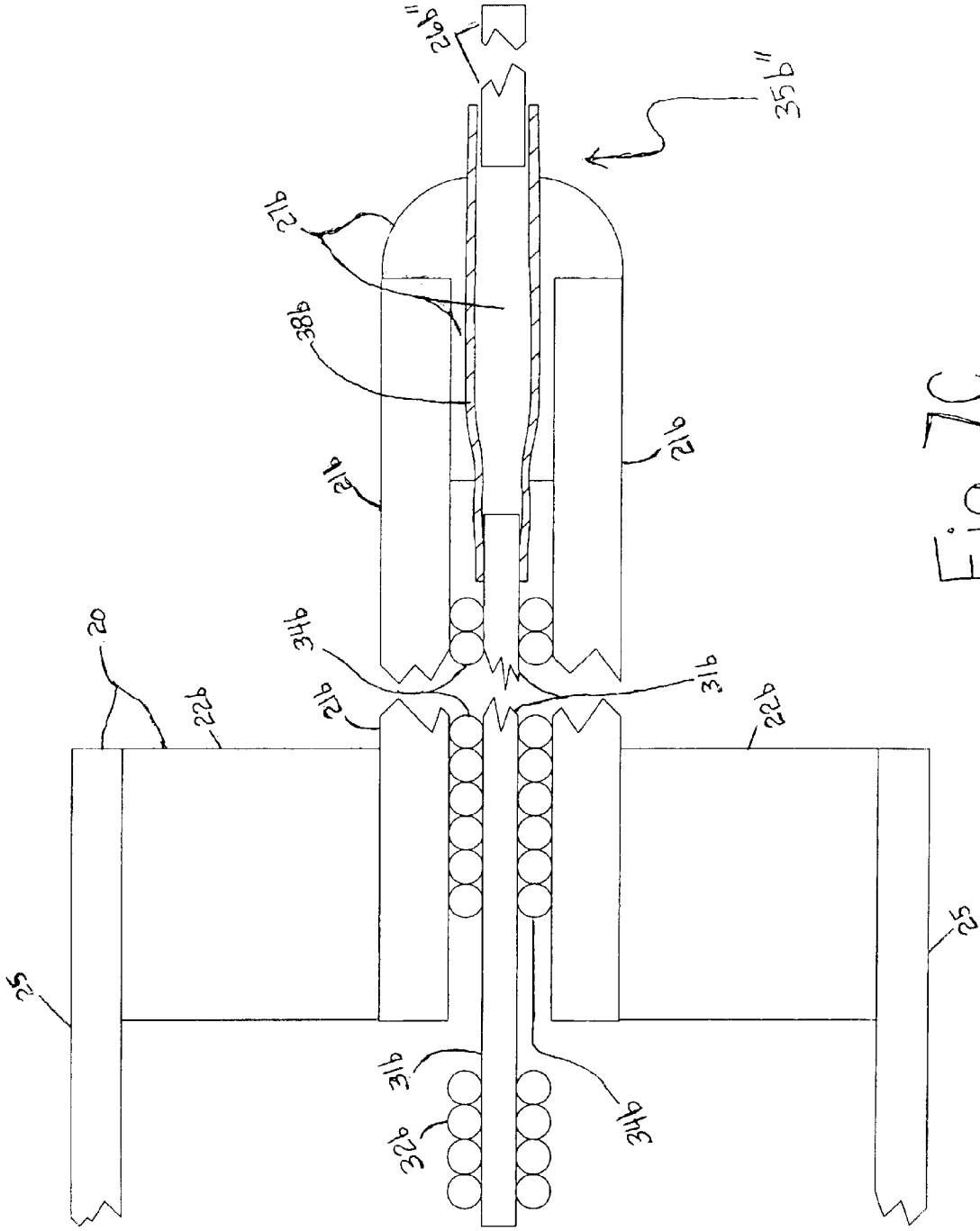
Figure 7D:
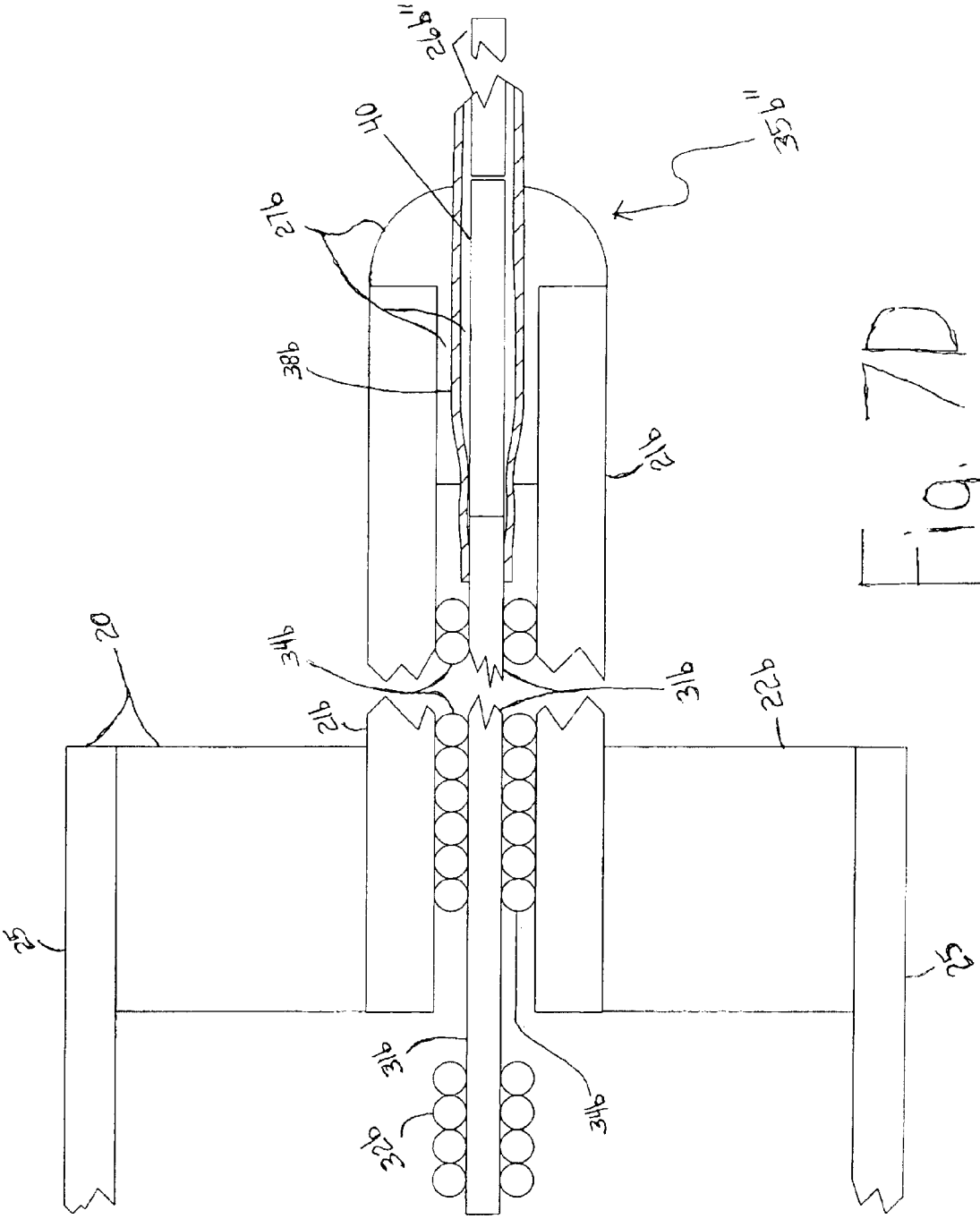

If formed foil 38*b* is further lengthened to extend substantially further outside of electrode tube 21*b* beyond the approximately hemispherical solid frit cap on the end of electrode tube 21*b*, the electrode arrangement outer part can be assembled to formed foil 38*b* after completion of the sealing of the remainder of the electrode arrangement 35*b*" with sealing frit 27*b* in electrode tube 21*b*. In this circumstance, a lower melting point temperature material can be used in place of niobium for such an outer part such as stainless steel or nickel. This outer part can be a rod or a foil strip, and the resulting electrode arrangement using a rod outer part, 26*b*", is shown in FIG. 7C. The mechanical strength of electrode assembly 35*b*" can be substantially increased by including an alumina rod, 40, in the bore of formed foil 38*b* as shown in FIG. 7D. Further, rod 40 may be used as a mandrel around which to form formed foil 38*b*, and then left in place as the parts are assembled into electrode arrangement.

Although the present invention has been described with reference to preferred embodiments, workers skilled in the art will recognize that changes may be made in form and detail without departing from the spirit and scope of the invention.

What is claimed is:

1. An arc discharge metal halide lamp for use in selected lighting fixtures, said lamp comprising:

a discharge chamber having electromagnetic radiation permeable walls bounding a discharge region of a selected volume in which ionizable materials are provided, and with at least one electrode accommodation opening provided in said walls extending along a selected path between said discharge region and a region outside said walls;

an electrode arrangement extending through said electrode accommodation opening having therein a thin electrical conductor positioned at least in part in said electrode accommodation opening with said thin electrical conductor being flexible with a major surface having extents in perpendicular surface directions that are both larger than that extent of said thin electrical conductor in a thickness direction perpendicular to said perpendicular surface directions, and said thin electrical conductor having an opposite surface on a side thereof opposite said major surface, said major surface of said thin electrical conductor exhibiting surface curvature in at least some of those portions thereof positioned in said electrode accommodation opening, there being a sealing flit of mixed metal oxides in contact with at least a portion of both said major surface and said opposite surface of said thin electrical conductor within said electrode accommodation opening; and a rod having at least a portion thereof extending along a portion of said major surface of said thin electrical conductor such that a portion of said sealing frit also is in contact with an end portion of said rod.

2. The device of claim 1 wherein said thin electrical conductor is of molybdenum.

3. The device of claim 1 further wherein said sealing frit also extends between said thin electrical conductor and said discharge chamber.

4. The device of claim 1 wherein said thin electrical conductor is wrapped about said path so that a spatial curve in said major surface substantially follows a helix spatial curve.

5. The device of claim 1 wherein said thin electrical conductor is wrapped about said path so that a spatial curve in said major surface substantially follows a circular curve in a spatial plane substantially perpendicular to said path at an intersection therewith.

6. The device of claim 1 wherein said thin electrical conductor is wrapped partially about said path so as to leave an open side substantially parallel to said path.

7. The device of claim 1 wherein said thin electrical conductor is a first thin electrical conductor and further comprising a second thin electrical conductor having a surface which at least in part faces said major surface of said first thin electrical conductor across said path.

8. The device of claim 1 wherein said thin electrical conductor is wrapped about said path so as to be closed about a bore containing said path with said bore having a first maximum bore opening extent perpendicular to said path at one end of said thin electrical conductor and a larger second maximum opening extent perpendicular to said path at an opposite end of said thin electrical conductor.

9. The device of claim 1 wherein said thin electrical conductor is wrapped at least partially about said path so as to be at least partially closed about an interior region containing said path, there being a second rod contained at least in part in said interior region.

10. The device of claim 1 wherein said thin electrical conductor has at least one edge where an interior thickness of said thin electrical conductor tapers over a distance to a zero thickness at that edge.

11. The device of claim 1 wherein said thin electrical conductor has an extent in said thickness direction that is less than 0.05 mm.

12. The device of claim 2 wherein said discharge tube walls are of alumina.

13. The device of claim 3 wherein said discharge tube is of alumina and said thin electrical conductor is of molybdenum.

14. The device of claim 1 wherein said rod extends from a portion of said thin electrical conductor nearest said discharge region into said discharge chamber.

15. The device of claim 1 wherein said rod extends from a portion of said thin electrical conductor furthest from said discharge region to said region outside said walls.

16. The device of claim 1 wherein said thin electrical conductor extends from within said electrode accommodation opening to said region outside said walls.

17. The device of claim 1 wherein said thin electrical conductor is wrapped about a further rod.

18. The device of claim 14 wherein said rod is welded to said thin electrical conductor.

19. The device of claim 15 wherein said rod is welded to said thin electrical conductor.

* * * * *

UNITED STATES PATENT AND TRADEMARK OFFICE

CERTIFICATE OF CORRECTION

PATENT NO. : 6,856,091 B2
DATED : February 15, 2005
INVENTOR(S) : Timothy Lee Kelly et al.

It is certified that error appears in the above-identified patent and that said Letters Patent is hereby corrected as shown below:

Column 10,
Line 67, delete "flit", insert -- frit --

Signed and Sealed this

Thirty-first Day of May, 2005

JON W. DUDAS
*Director of the United States Patent and Trademark Office*